United States Patent [19]

Iida

[11] 4,397,279

[45] Aug. 9, 1983

[54] AIR-FUEL RATIO CONTROL SYSTEM FOR AN INTERNAL COMBUSTION ENGINE

[75] Inventor: Katsuyoshi Iida, Hiroshima, Japan

[73] Assignee: Toyo Kogyo Co., Ltd., Hiroshima, Japan

[21] Appl. No.: 279,214

[22] Filed: Jun. 30, 1981

[30] Foreign Application Priority Data

Jul. 7, 1980 [JP] Japan ..... 55-93142

[51] Int. Cl.[3] ..... F02M 7/16

[52] U.S. Cl. ..... 123/440; 123/489

[58] Field of Search ..... 123/440, 489

[56] References Cited

U.S. PATENT DOCUMENTS

| | | | |
|---|---|---|---|
| 3,895,611 | 7/1975 | Endo et al. | 123/489 X |
| 4,111,171 | 9/1978 | Aono et al. | 123/440 |
| 4,122,811 | 10/1978 | Bowler et al. | 123/440 |
| 4,203,394 | 5/1980 | Aono et al. | 123/440 |
| 4,224,910 | 9/1980 | O'Brien | 123/440 |
| 4,237,839 | 12/1980 | Veno et al. | 123/489 X |
| 4,357,828 | 11/1982 | Nakano | 123/440 X |

*Primary Examiner*—Tony M. Argenbright

*Attorney, Agent, or Firm*—Wenderoth, Lind & Ponack

[57] ABSTRACT

An air-fuel ratio control system for an automobile engine including a source of combustible air-fuel mixture on an intake passage and an exhaust gas purifying unit on an exhaust passage includes a composition sensor for generating an output signal indicative of the concentration of a particular component of exhaust gases flowing through the exhaust passage, a control unit for generating a control signal in dependence on the output signal, a pressure sensor for generating a pressure signal indicative of the pressure inside the intake passage, and an actuator operable in response to the control signal to adjust the air-fuel mixing ratio to a predetermined optimum value. The control unit is so designed to fix the duty ratio of the control signal at a mean value of the highest and lowest values of the duty ratio of the previous control signal if it has attained a generally identical value two or more times consecutively.

4 Claims, 4 Drawing Figures

AIR-FUEL RATIO CONTROL SYSTEM FOR AN INTERNAL COMBUSTION ENGINE

BACKGROUND OF THE INVENTION

The present invention generally relates to an air-fuel ratio control system for adjusting the air-fuel mixing ratio of a combustible air-fuel mixture, formed for an automobile internal combustion engine, to a predetermined or desired value and, more particularly, to a closed-loop air-fuel ratio control system which is effective to carry out the adjustment of the air-fuel mixing ratio according to a feed-back control scheme in dependence on the concentration of a selected component of exhaust gases emitted from the engine.

The control system of the type referred to above is shown and described in numerous patent publications and is, therefore, well known to those skilled in the art. Briefly speaking the control system comprises an electric circuit including a composition sensor for detecting the concentration of a component, usually oxygen, contained in the exhaust gases, and for generating a composition signal indicative of the detected concentration, a first controller which is operable in response to the composition signal to generate a ratio signal indicative of an optimum air-fuel mixing ratio based on the concentration of the detected component in the exhaust gases, a second controller which is operable in response to the ratio signal to generate a control signal, a parameter of which control signal is a function of the ratio signal, and an actuator electrically which is connected to the second controller to optimally control the air-fuel mixing ratio of the combustible mixture to be fed to the engine in dependence on the parameter of the control signal. The control of the air-fuel mixing ratio in dependence on the concentration of the exhaust gas component is possible in view of the fact that the concentration of the exhaust gas component is a function of the air-fuel mixing ratio of the combustible mixture which has been prepared in a carburetor and has subsequently burned in the engine.

The actuator which has been employed in the well known control system and referred to above is usually an electromagnetic valve provided in an air passage connected at one end thereof to an air bleed chamber in a carburetor or to another air passage bypassing the intake passage wherein a carburetor throttle valve is disposed. In either case, the air-fuel mixing ratio of the combustible mixture being supplied to the engine is optimized by selectively initiating and interrupting the supply of an additional air necessary respectively to lean and enrich the combustible mixture according to engine operating conditions.

In this well known control system, since the preparation of the combustible mixture of a definite air-fuel mixing ratio and the detection of the concentration of the particular component of the exhaust gases formed as a result of combustion of such combustible mixture of the definite air-fuel mixing ratio takes place at different times, a delay is inevitably involved, which delay brings about hunting of the signals being processed through the electric circuitry. The consequence is that the combustible mixture to be supplied to the engine tends to be alternately enriched and leaned relative to a predetermined air-fuel mixing ratio, the cycle of the alternation being dependent on the magnitude of the delay referred to above. Specifically, where the control gain in the electric circuitry is fixed, the larger the delay, the larger the deviation of the air-fuel mixing ratio from the predetermined optimum value, that is, the larger the hunting of the signals being processed in the circuitry.

Thus, with the well known control system described above, even during a normal operating condition of the engine wherein the air-fuel mixing ratio does not greatly deviate from the predetermined value, the delay in the system brings about hunting, resulting in a difficulty in maintaining the optimum air-fuel mixing ratio.

In order to substantially eliminate the above described problem, two techniques have been suggested. One technique is disclosed, for example, in Japanese Laid-open Patent Publication No. 51-124739 which was laid open to public inspection on Oct. 30, 1976. This publication discloses the employment of an idling sensor, an output signal of which is used to vary the control gain of the system to minimize the hunting which would occur during an idling of the engine. The idling sensor used therein is described as operable to detect one parameter or a combination of parameters representative of the idling of the engine, which parameters include the opening of the carburetor throttle valve, the engine speed, the position of an automobile transmission and the negative pressure inside the intake manifold.

However, minimization of the hunting achieved by the system of the above mentioned publication is still far from eliminating the previously discussed problem.

The other technique is disclosed, for example, in Japanese Laid-open Patent Publication No. 51-149420 which was laid open to public inspection on Dec. 22, 1976. This publication discloses the use of a circuit means including an idling sensor for generating a command signal in response to the detection of the idling of the engine, which command signal is used to disable the control system when the idling of the engine continues for more than a predetermined time and/or when the automobile starts running after the idling of the engine has continued for more than the predetermined time. As is the case with that in the first mentioned publication, the idling sensor used herein is operable to detect one parameter or a combination of the parameters representative of the engine idling condition.

Although the system disclosed in the second mentioned publication is effective to eliminate the hunting, optimization of the air-fuel mixing ratio of the combustible mixture to be supplied to the engine is sacrificed during the period in which the control system is disabled.

SUMMARY OF THE INVENTION

Accordingly, the present invention has been developed with a view to substantially eliminating the disadvantages and inconveniences inherent in the prior art closed-loop air-fuel control systems and has for its essential object to provide an improved closed-loop air-fuel control system featured in that, by monitoring the control signal to find out whether or not the engine is operated under normal operating conditions, the control signal is fixed at a value equal to a mean value of hunting amplitudes of such control signal when the engine is operated under the normal operating conditions, so that the air-fuel mixing ratio of the combustible mixture can be maintained at the predetermined optimum value substantially continuously without being adversely affected by the hunting of the control signal.

BRIEF DESCRIPTION OF THE DRAWING

These and other objects and features of the present invention will become clear from the subsequent description taken in conjunction with a preferred embodiment thereof with reference to the accompanying drawings, in which.

DETAILED DESCRIPTION OF THE EMBODIMENT

Figure 1:
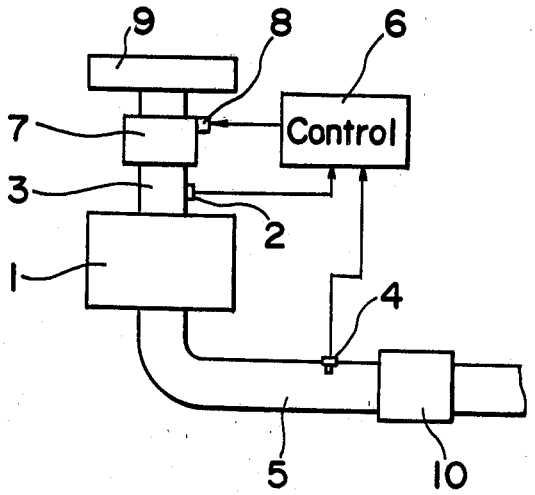
FIG. 1 is a schematic diagram showing an air-fuel mixing ratio control system used in association with an automobile engine according to the present invention.

Referring first to FIG. 1, an automobile power plant comprises an internal combustion engine 1 having a fuel intake system and an exhaust system. The fuel intake system includes a carburetor 7 of any known construction communicated to one or more engine cylinders (not shown) of the engine 1 by means of an intake manifold 3 on the one hand and to the atmosphere through an air cleaner 9 on the other hand. So far shown, the carburetor 7 is provided with an actuator 8 for adjusting the air-fuel mixing ratio of a combustible mixture independently of a carburetor throttle valve (not shown) generally built in the carburetor 7. As is the case with the prior art air-fuel control system, the actuator 8 comprises an electromagnetic valve which may be provided in an air passage connected at one end thereof either to an air bleed chamber in the carburetor 7 or to a bypass passage bypassing the fuel intake system around the carburetor throttle valve.

The exhaust system includes an exhaust manifold 5 having a catalytic converter 10, for example, a three-way catalytic converter, installed thereon.

The construction and function of the power plant so far described above are well known to those skilled in the art and, therefore, the details thereof are herein omitted for the sake of brevity.

In accordance with the present invention the intake manifold 3 has a pressure sensor 2 for detecting the negative pressure developed inside the intake manifold 3 downstream of the carburetor throttle valve (not shown) with respect to the direction of flow of the combustible mixture towards the engine 1 and for generating an intelligence or pressure signal corresponding thereto, said intelligence or pressure signal being in turn supplied to a control unit 6. On the other hand, the exhaust manifold has a composition sensor 5, for example, an oxygen sensor, of any known construction installed on a portion of the exhaust duct 5 between the engine 1 and the catalytic converter 10 for detecting the concentration of a selected component, for example, oxygen, of the exhaust gases emitted from the engine and for generating a concentration signal corresponding thereto, said concentration signal being in turn supplied to the control unit 6. As is well known to those skilled in the art, the concentration of the selected exhaust gas component is a function of the air-fuel mixing ratio of the combustible mixture which has been burned in the engine 1.

The control unit 6 is constituted by a computer, preferably a microcomputer, used as a synthesizer for synthesizing a control signal in the form of a pulse on the basis of the pressure signal or intelligence signal from the pressure sensor 2 and the concentration signal from the composition sensor 4.

Figure 2:
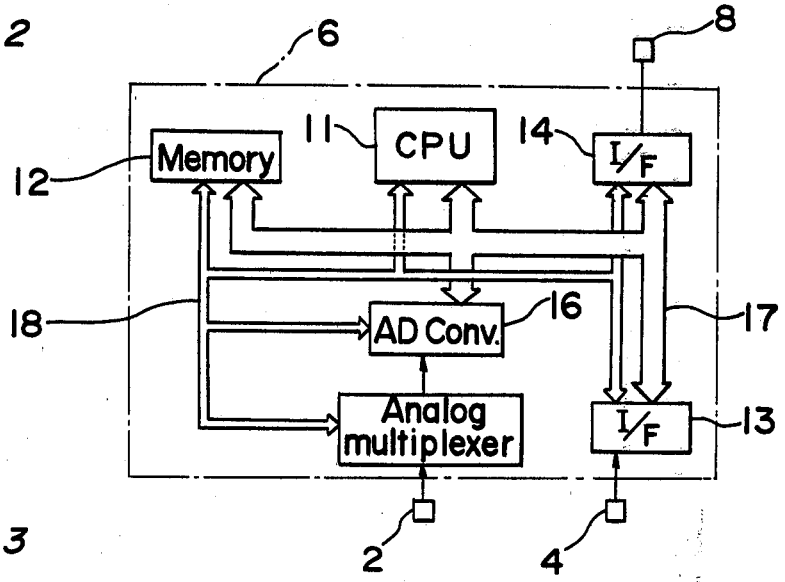
FIG. 2 is a schematic block diagram showing a computer used in the system of the present invention.

Referring to FIG. 2 which shows schematically internal circuit components of the control unit 6, that is, the computer, the computer constituting the control unit 6 includes a central processor 11, a memory 12, an input interface circuit 13 for receiving the concentration signal from the composition sensor 4, an output interface circuit 14 for generating the control signal to be supplied to the actuator 8, an analog multiplexer 15 for receiving the pressure signal from the pressure sensor 2, an A/D converter for performing an A/D conversion subject to the output from the analog multiplexer 15, an address data bus 17 for distributing address signals and data among the components 11, 12, 13, 14 and 16, and a control bus 18 for distributing control signals among the components 11, 12, 13, 14, 15 and 16.

Figure 3:
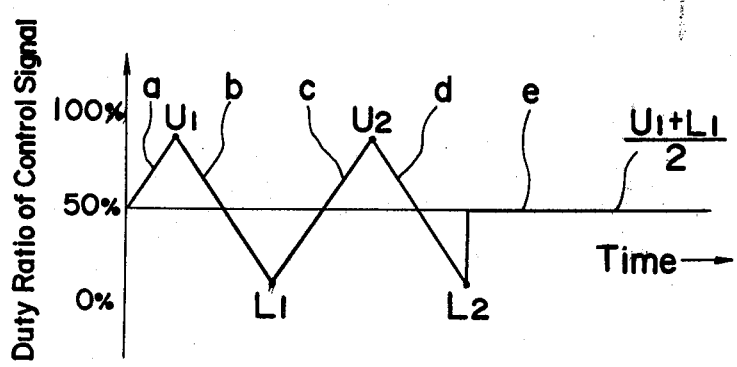
FIG. 3 is a diagram showing the waveform of a control signal processed in the system of the present invention.

The system shown in FIG. 1 is so designed as to function in the following manner. At any time during which the engine 1 is operated, the composition sensor 4 detects the concentration of oxygen contained in the exhaust gases, the concentration signal indicative of such oxygen concentration being fed to the computer 6, whereas the pressure sensor 2 detects the negative pressure inside the intake manifold 3, the pressure signal indicative of such negative pressure being fed to the computer 6. In the computer 6, the concentration signal is supplied to the central processor 11 through the input interface circuit 13 while the pressure signal is supplied to the central processor 11 through the analog multiplexer 15 and then through the A/D converter 16. Based on the concentration and composition signals, the central processor 11 determines whether the combustible mixture burned in the engine has been enriched or leaned relative to a predetermined optimum air-fuel mixing ratio and controls the control signal to be applied to the actuator 8 in such a way as to increase the duty ratio of the control signal for the purpose of leaning the combustible mixture supplied to the engine 1 when the combustible mixture burned in the engine 1 has been enriched and also to decrease the duty ratio of the control signal for the purpose of enriching the combustible mixture supplied to the engine 1 when the combustible mixture burned in the engine 1 has been leaned. In view of this, the control signal applied to the actuator 8 varies in a manner as shown by the waveform of FIG. 3. More specifically, referring to FIG. 3, where the combustible mixture burned in the engine 1 has been rich, the duty cycle of the control signal increases linearly as shown by a. However, when the combustible mixture burned in the engine 1 has subsequently been found to be lean and the state of the concentration signal from the composition sensor 4 has been accordingly reversed to show that the burned combustible mixture has been lean, the duty cycle of the control signal decreases linearly as shown by b so that the combustible mixture supplied to the engine 1 can be enriched. The supply of the enriched combustible mixture in turn result in reversion of the state of the concentration signal from the composition sensor 4 to show that the burned combustible mixture has been rich with the result that the duty cycle of the control signal again increases linearly as shown by c, so that the combustible mixture supplied to the engine 1 can be leaned, the consequence of which is that the duty cycle of the control signal again decreases linearly as shown by d by the reason similar to that described above.

In this mode of operation, if two or more consecutive mean values of the duty ratios of the consecutive control signals expressed by $(U_1+L_1)/2$, $(L_1+U_2)/2$ and $(U_2+L_2)/2$ wherein $U_1$ and $U_2$ represent the highest values of the duty ratios of the control signals and $L_1$ and $L_2$ represent the lowest values of the duty ratios of the control signals attain a generally identical value, that is, when $(U_1+L_1)/2=(L_1+U_2)/2=(U_2+L_2)/2$, such is detected by the computer 6 and the computer 6 serves to fix the duty cycles of the succeeding control signals at the mean value as shown by e in FIG. 3.

The fact that the two or more consecutive mean values of the duty ratios of the control signals attain a generally identical value takes place when and so long as the engine 1 is operated under normal operating conditions. Accordingly, by fixing the duty ratios of the control signals at a predetermined value when and so long as the engine 1 is operated under such normal operating conditions, the air-fuel mixing ratio of the combustible mixture to be supplied to the engine 1 can advantageously be maintained at the predetermined optimum value without the air-fuel mixing ratio being substantially accompanied by the hunting phenomenon.

Figure 4:
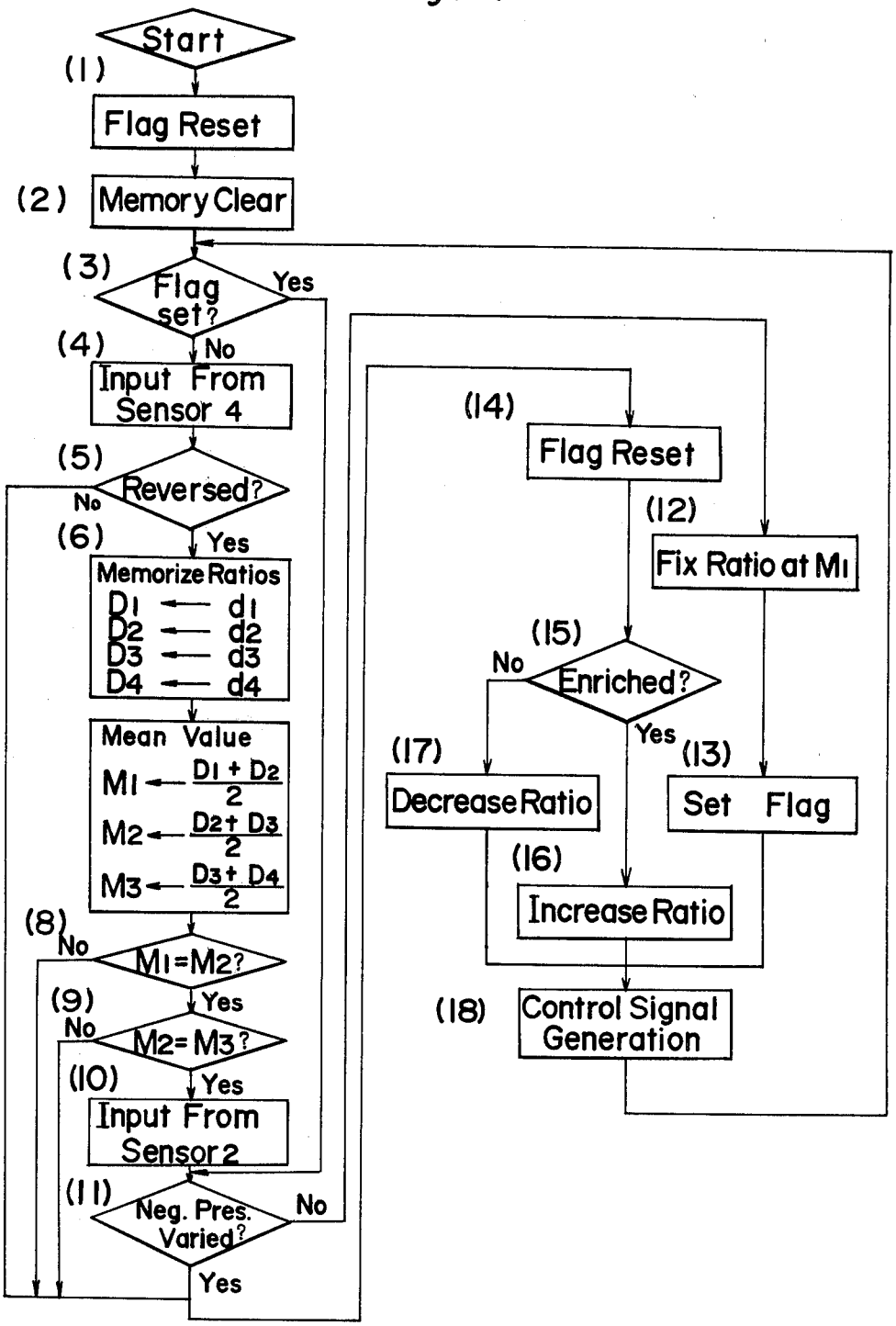
FIG. 4 is a flow chart showing the sequence of operation of the computer shown in FIG. 2.

The operation of the computer 6 will now be described in detail with reference to the flow chart shown in FIG. 4.

Assuming that the computer 6 is set in operation, the flag is reset at step (1) and all of the memories are cleared at the subsequent step (2). At step (3), a determination is made to find whether or not the flag is set and, if it has been found that the flag is not set, the concentration signal from the composition sensor 4 is received by the central processor at step (4). Thereafter, at step (5), a check is made as to whether or not the state of the concentration signal is reversed and, if it has been found that the state of the concentration signal is reversed, the duty ratio of the control signal, that is, the highest or lowest value $d_4$ of the duty ratio, is written into memory address $D_4$ at step (6). So far as is illustrated in FIG. 4, it is assumed for the simplification of the description that a similar process to that described above in connection with steps (1) to (6) have already been performed three consecutive times and the respective highest or lowest values $d_3$,$d_2$ and $d_1$, have been written in corresponding addresses $D_3$, $D_2$ and $D_1$.

At step (7), a mean value of the sum of the contents stored in the memory address $D_3$ and that stored in the memory address $D_4$ is determined and is written in a memory address $M_1$. It is to be noted that respective mean values of the sum of the contents stored in the memory address $D_2$ and that in the memory address $D_3$ and of the sum of the contents stored in the memory address $D_1$ and that stored in the memory address $D_2$ have already been determined and written in corresponding addresses $M_2$ and $M_1$.

At the next succeeding step (8), a check is made as to whether or not the contents stored at the respective memory addresses $M_1$ and $M_2$ are equal to each other and, if they are equal (i.e., when it has been found that the mean value of the sum of the highest and lowest values of the duty ratio of one control signal is equal to that of the next succeeding control signal), the pressure signal from the pressure sensor 2 is permitted to enter the central processor at the step (10). Subsequently, at the step (11), a check is made as to whether the negative pressure sensed by the pressure sensor 2 has changed. If the negative pressure so sensed has not changed which means that no change have occurred in the engine operating condition, the duty ratio of the control signal is fixed at the mean value $M_1$ at step (12) and the flag is set at step (13). However, if the negative pressure so sensed is found to have changed at step (11), since the feed-back control of the air-fuel mixing ratio has to be continued, the flag is reset at step (14) and, at the subsequent step (15), a check is made as to whether or not the combustible mixture burned in the engine has been rich. If it is found that the combustible mixture burned has been rich at step (15), the duty ratio is increased at step (16), but if it is found that the combustible mixture burned has been lean, the duty ratio is decreased at step (17). Subsequent to any one of the steps (13), (16) and (17), i.e., at step (18), the control signal of a controlled duty ratio is generated by the computer 6 and fed to the actuator 8 so that the later can be controlled according to the duty ratio of the control signal so generated.

Since the feed-back control has to be continued in the event that the result of check performed at any one of the steps (5), (8) and (9) is contrary to that described above, steps (5), (8) or (9) is each followed by step (14) and the subsequent steps are successively performed in a manner similar to that described above until the control signal of a controlled duty ratio is generated at step (18).

The final step (18) of the generation of the control signal is followed by step (3) so long as the computer is in operation and, if it is found that the flag is set at step (3), this means that the duty ratio of the control signal has still been fixed. The step (3) is followed by step (11) if the flag has been found set at step (3) and, at step (11), a check is again made as to whether or not the engine operating condition has changed. If the engine operating condition has been found to have not changed at step (11), the duty ratio of the control signal is still fixed at the mean value. However, if change has been found to have occurred in the negative pressure, the once predetermined air-fuel mixing ratio has to be adjusted and, for this purpose, subsequent to the setting of the flag at step (14), the steps (15) to (18) are successively repeated to again initiate the feed-back control.

It is to be noted that if it is found that the flag has not been set at step (3), this means that the feed-back control is in progress and, therefore, a function to monitor the control signal is repeated subsequent to step (4).

If the foregoing embodiment, it has been described that the control signal is in the form of a digital signal having a variable duty ratio and that the control unit is constituted by a computer capable of dealing with digital signals. However, it is possible to employ an analog circuit for the control unit in place of the computer, in which case the control signal should be in the form of an analog signal.

From the foregoing, it has become clear that the present invention is arranged such that the duty ratio of the control signal is increased or decreased depending on the concentration of the exhaust gas component sensed by the composition sensor and that if the mean values of the highest and lowest values of the duty ratios or two or more consecutive control signals attain a generally identical value, the duty ratio of the control signal is fixed at a value equal to the means values. Accordingly, not only can the information of the air-fuel mixing ratio be fed back, but also any possible occurrence of the hunting in the control signal can be eliminated, for the purpose of optimizing the air-fuel mixing ratio of the combustible mixture at all times during the normal operating condition of the automobile engine.

Although the present invention has fully been described in connection with the preferred embodiment thereof with reference to the accompanying drawings, it is to be noted that various changes and modifications are apparent to those skilled in the art. Such changes and modifications are to be understood as included within the true scope of the present invention unless they depart therefrom.

I claim:

1. An air-fuel ratio control system for an internal combustion engine including a source of combustible air-fuel mixture, an intake passage means for supplying the combustible mixture from the mixture source to the engine, and an exhaust passage means including an exhaust gas purifying unit installed thereon between the engine and the atmosphere, said control system comprising a composition sensor provided on the exhaust passage means at a position between the purifying unit and the engine for detecting the concentration of a particular component contained in exhaust gases emitted from the engine, said concentration being a function of the air-fuel mixing ratio of the combustible mixture burned in the engine, said composition sensor generating an output signal capable of respectively assuming first and second states when the concentration of the particular exhaust gas component is high and low; a control means for determining whether the output signal is in the first state or in the second state and for generating a control signal of a value either increasing or decreasing depending on the output signal when and so long as no change has occurred in the state of the output signal, said control means being further operable, when change has occurred in the state of the output signal, to determine whether the mean value of the highest and lowest values of the control signal has attained a generally identical value at least two times consecutively and also to generate the control signal of the value either increasing or decreasing depending on the output signal if the mean value has not attained a generally identical value at least two times consecutively and to generate a control signal of a value fixed at the means value if the mean value has attained a generally identical value at least two times consecutively; and an actuator operable in response to the control signal to adjust the air-fuel mixing ratio of the combustible mixture supplied to the engine so as to be a predetermined optimum value.

2. A system as claimed in claim 1, further comprising a means for detecting variations in an engine operating condition and for generating an intelligence signal indicative of such variations in the engine operating condition, said control means, upon receipt of said intelligence signal, cancelling said control signal of the fixed value, but then again generating the output signal in dependence on the output signal from the composition sensor.

3. A system as claimed in claim 2, wherein said detecting means comprises a pressure sensor provided on the intake passage means for providing said intelligence signal, said intelligence signal being indicative of a change in pressure prevailing inside the intake passage means.

4. A system as claimed in claims 1 or 2 or 3, wherein said control means comprises a computer.

* * * * *